US010883459B2

(12) United States Patent
Hanke et al.

(10) Patent No.: US 10,883,459 B2
(45) Date of Patent: Jan. 5, 2021

(54) MOTOR VEHICLE FUEL PUMP COVER, MOTOR VEHICLE FUEL PUMP HAVING SUCH A COVER, AND METHOD FOR PRODUCING SAID COVER

(71) Applicant: Bayerische Motoren Werke Aktiengesellschaft, Munich (DE)

(72) Inventors: Daniel Hanke, Oberschleissheim (DE); Henryk Freund, Markt Schwaben (DE); Erika Duschl, Wolnzach (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/257,276

(22) Filed: Jan. 25, 2019

(65) Prior Publication Data

US 2019/0153984 A1 May 23, 2019

Related U.S. Application Data

(63) Continuation of application No. PCT/EP2017/067358, filed on Jul. 11, 2017.

(30) Foreign Application Priority Data

Jul. 26, 2016 (DE) ..... 10 2016 213 727

(51) Int. Cl.
*F02M 37/20* (2006.01)
*F02M 59/42* (2006.01)
*F02M 59/44* (2006.01)

(52) U.S. Cl.
CPC ..... *F02M 37/20* (2013.01); *F02M 59/42* (2013.01); *F02M 59/44* (2013.01);
(Continued)

(58) Field of Classification Search
CPC ..... F02M 37/20; F02M 59/44; F02M 59/42; F02M 59/445; F02M 2200/9015; F02M 2200/60
See application file for complete search history.

(56) References Cited

U.S. PATENT DOCUMENTS 8,580,171 B2 11/2013 Christ et al.
2001/0018120 A1* 8/2001 Murakami ..... B29C 61/0608 428/304.4

(Continued)

FOREIGN PATENT DOCUMENTS

CN 103097715 A 5/2013
DE 10 2006 056 600 A1 6/2007

(Continued)

OTHER PUBLICATIONS

International Search Report (PCT/ISA/210) issued in PCT Application No. PCT/EP2017/067358 dated Oct. 19, 2017 with English translation (six (6) pages).

(Continued)

*Primary Examiner* — Joseph J Dallo
(74) *Attorney, Agent, or Firm* — Crowell & Moring LLP

(57) ABSTRACT

A motor vehicle fuel pump cover is provided for covering a fuel guide region of a motor vehicle fuel pump by way of a cover housing. A phase change core is received in the cover housing. The phase change core is designed to change the phase state thereof while receiving thermal energy from the fuel guide region. The phase change core is designed for phase change at a temperature of more than 60° C.

10 Claims, 1 Drawing Sheet

(52) U.S. Cl.
CPC ..... *F02M 59/445* (2013.01); *F02M 2200/60* (2013.01); *F02M 2200/9015* (2013.01)

(56) References Cited

U.S. PATENT DOCUMENTS

| | | | | |
|---|---|---|---|---|
| 2002/0108807 | A1* | 8/2002 | Murakami | F02B 77/13 181/204 |
| 2007/0128058 | A1 | 6/2007 | Kitamura | |
| 2009/0229580 | A1 | 9/2009 | Kopinsky | |
| 2012/0312279 | A1* | 12/2012 | Powell | F02M 31/16 123/456 |
| 2013/0098338 | A1 | 4/2013 | Usui et al. | |

FOREIGN PATENT DOCUMENTS

| | | | | |
|---|---|---|---|---|
| DE | 11 2011 105 591 T5 | | 7/2014 | |
| DE | 10 2013 211 176 A1 | | 12/2014 | |
| DE | 102013211176 A1 | * | 12/2014 | F02M 59/44 |
| EP | 0 995 897 A2 | | 4/2000 | |
| EP | 1 837 385 A2 | | 9/2007 | |
| JP | 2013-185452 A | | 9/2013 | |
| JP | 2013185452 A | * | 9/2013 | |
| WO | WO 2017/157723 A1 | | 9/2017 | |

OTHER PUBLICATIONS

German-language Written Opinion (PCT/ISA/237) issued in PCT Application No. PCT/EP2017/067358 dated Oct. 19, 2017 (five (5) pages).

German Search Report issued in counterpart German Application No. 10 2016 213 727.1 dated May 2, 2017 with partial English translation (nine (9) pages).

Chinese-language Office Action issued in Chinese Application No. 201780029758.X dated Jun. 28, 2020 with English translation (11 pages).

* cited by examiner

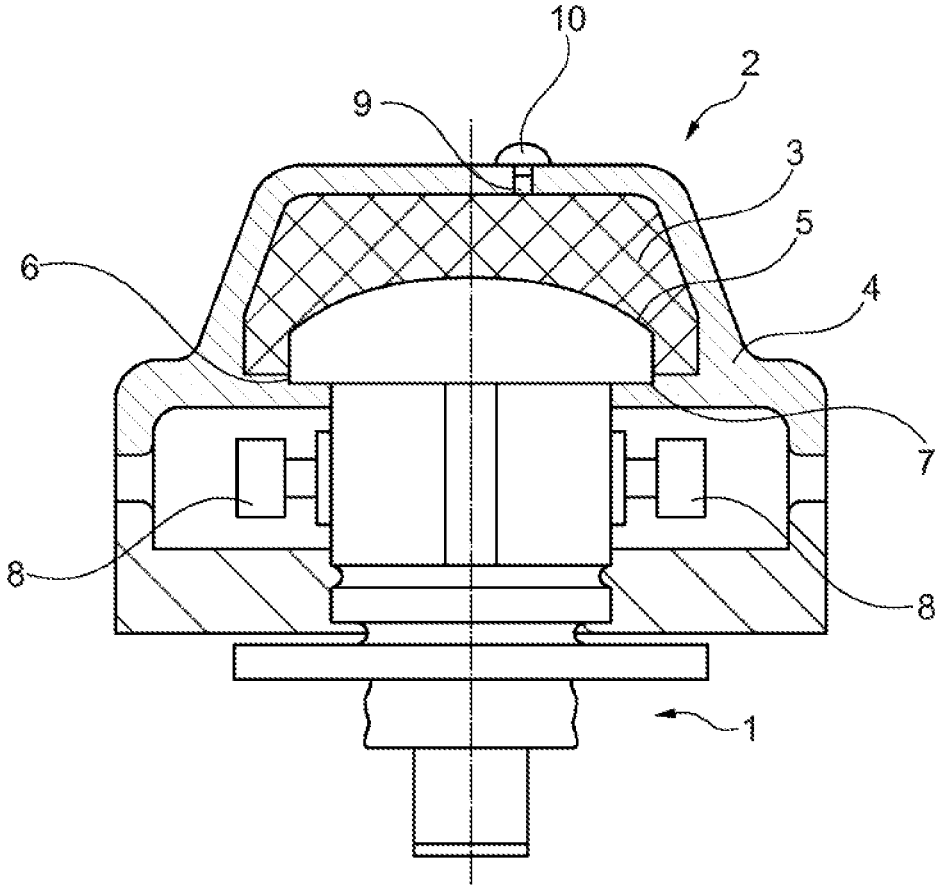
10
2
9
3
5
6
4
7
8
8
1

MOTOR VEHICLE FUEL PUMP COVER, MOTOR VEHICLE FUEL PUMP HAVING SUCH A COVER, AND METHOD FOR PRODUCING SAID COVER

CROSS REFERENCE TO RELATED APPLICATIONS

This application is a continuation of PCT International Application No. PCT/EP2017/067358, filed Jul. 11, 2017, which claims priority under 35 U.S.C. § 119 from German Patent Application No. 10 2016 213 727.1, filed Jul. 26, 2016, the entire disclosures of which are herein expressly incorporated by reference.

BACKGROUND AND SUMMARY OF THE INVENTION

The invention relates to a cover for a motor vehicle fuel pump and to a motor vehicle fuel pump having such a cover, as well as to a method for producing the cover. Motor vehicle fuel pumps having a cover are generally known from the prior art, in particular from DE102006056600 A1.

The motor vehicle fuel pump is provided for supplying fuel to an internal combustion engine of the motor vehicle, and is generally arranged in the engine compartment.

DE 10 2006 056 600 A1 discloses a fuel pump having a cover for conveying fuel in a motor vehicle to an internal combustion engine.

On account of the waste heat of the internal combustion engine, temperatures of more than 50° C. prevail in the engine compartment after a considerable driving time. After the motor vehicle has been switched off, this temperature may initially rise further on account of a lack of cooling when the internal combustion engine is switched off. The rise in temperature may lead to vapor bubble formation in the fuel which remains in the fuel pump. If the still-hot internal combustion engine is started again thereafter, i.e. if a warm start of the motor vehicle is carried out, the fuel contaminated with vapor bubbles is conveyed to combustion spaces of the internal combustion engine, and this may lead to irregularities in the combustion or starting difficulties. This is undesirable.

It is an object of the invention to provide a motor vehicle fuel pump cover, a motor vehicle fuel pump having such a cover, and a method for producing such a cover, these making it possible to improve the warm-start behavior of the internal combustion engine. This object is achieved by a motor vehicle fuel pump cover, which can be produced by a production method, and by a motor vehicle fuel pump having the cover, in accordance with embodiments of the invention.

A motor vehicle fuel pump cover is provided for covering a fuel guide region of a motor vehicle fuel pump. For covering, the motor vehicle fuel pump cover comprises a cover housing. A phase change core is accommodated in the cover housing. The phase change core is designed to change its phase state taking up thermal energy from the fuel guide region. In this respect, phase change materials and components consisting thereof are known as such, and a phase change is to be understood as meaning in particular a change in the aggregate state. Furthermore, the phase change core is designed such that the phase change takes place, or begins, at a temperature of more than 60° C. It is further preferable that the phase change occurs at a temperature of more than 75° C., preferably at more than 90° C., and particularly preferably at more than 100° C.

For the purposes of the invention, a motor vehicle fuel pump is to be understood as meaning a device for conveying fuel to the internal combustion engine. The fuel is preferably gasoline; in this respect, the type of fuel may be important, since diesel fuel generally tends toward vapor bubble formation only at higher temperatures. The motor vehicle fuel pump is preferably to be understood as being a high-pressure pump, which can be used to convey the fuel in particular at a pressure of more than 100 bar, preferably at more than 200 bar, and particularly preferably at more than 300 bar.

For the purposes of the invention, a motor vehicle fuel pump cover is to be understood as meaning a device with which a surface region of the motor vehicle fuel pump of the aforementioned type is coverable. In this context, coverable is to be understood as meaning geometrical covering or concealing.

For the purposes of the invention, a fuel guide region is to be understood as meaning a surface region of the motor vehicle fuel pump. The fuel guide region is preferably arranged on a surface, preferably a wall, of the motor vehicle fuel pump. The wall preferably is contactable by the fuel to be conveyed during correct operation of the motor vehicle fuel pump. In the case of such a configuration, the wall is contactable from one side by fuel to be conveyed and from the opposite side by the motor vehicle fuel pump cover. The fuel guide region is thus in particular a surface region of the motor vehicle fuel pump via which thermal energy can be extracted in a particularly suitable manner from the fuel located in the motor vehicle fuel pump. A basic concept of the invention is, in particular, to arrange the motor vehicle fuel pump cover in such a manner that the thermal path between the fuel to be conveyed and the cover is as short as possible, or the thermal resistance is low during the transfer of the thermal energy to the motor vehicle fuel pump cover.

For the purposes of the invention, a phase change core is to be understood as meaning a body which consists of a phase change material. In this respect, what are termed phase change materials are known as such from the prior art. In particular, such phase change materials are distinguished by a low melting point, preferably in the region of 150° C. or less, and preferably a high heat storage capacity, preferably of 100 kJ/kg or more, given a temperature difference of 15° K, and also by the fact that the phase changes solid/liquid, liquid/solid can be repeated reversibly and multiply.

For the purposes of the invention, a phase change of the phase change core is to be understood as meaning a transition of the phase change core from a solid state to a liquid state, or vice versa.

In a preferred embodiment, the phase change core (or preferably a multiplicity of phase change cores) is partially or preferably completely surrounded by the cover housing. In particular, the partial surrounding of the phase change core by the cover housing makes it possible for the phase change core to have a free surface, with which the fuel guide region of the motor vehicle fuel pump is directly contactable. In particular, a completely surrounded phase change core makes it possible for the core to be accommodated in a particularly secure manner in the cover housing.

In a preferred embodiment, as one constituent, the cover housing comprises a plastic or preferably consists thereof. It is preferable that a plastic of this type is embodied as a foam, and further preferably as a closed-pore foam. The closed-pore foam is preferably in the form of a plastics foam. A foam of this type is preferably in the form of a polyurethane foam. In particular, a closed-pore plastics foam has a certain flexibility, and this has proved to be advantageous for the ability of the motor vehicle fuel pump cover to be mounted on the motor vehicle fuel pump.

In a preferred embodiment, as one constituent, the phase change core comprises a wax or a paraffin or preferably consists thereof. In particular, these materials have proved to be particularly advantageous for application in a motor vehicle fuel pump cover. It is further preferable that, as one constituent, the phase change core comprises graphite; phase change materials of this type are known, for example, from U.S. Pat. No. 8,580,171 B2.

The motor vehicle fuel pump cover according to the invention can be mounted on a motor vehicle fuel pump, in particular on a motor vehicle fuel pump for gasoline, i.e. in particular a motor vehicle gasoline pump.

The fuel guide region of the motor vehicle fuel pump is preferably in the form of a portion of the outer surface of the motor vehicle fuel pump. It is preferable that, in the state mounted on the motor vehicle fuel pump as planned, the cover housing has an inner surface. The inner surface is preferably arranged lying opposite the outer surface of the fuel guide region. It is further preferable that the inner surface and the outer surface delimit a hollow space. It is further preferable that the phase change core is arranged in the hollow space. In particular, this formation of the hollow space makes it possible for the phase change core to directly contact the motor vehicle fuel pump directly at the surface thereof, namely in the fuel guide region. In particular, the direct contacting of the surface of the motor vehicle fuel pump allows for a particularly good transfer of heat from the latter to the phase change core.

In a preferred embodiment, the cover housing is connected in a form-fitting manner to the motor vehicle fuel pump. The cover housing preferably forms a latching connection with the motor vehicle fuel pump. In particular, a form-fitting connection makes it possible for the motor vehicle fuel pump cover to be fastened in a particularly simple manner on the motor vehicle fuel pump.

In a method for producing a motor vehicle fuel pump cover according to the invention, firstly the phase change core is provided, preferably in a solid state. In a further step, the phase change core is partially or preferably completely encased with the cover housing. In a further step, the motor vehicle fuel pump cover is shaped. In this context, the shaping is to be understood as meaning, in particular, the removal of the cover housing with the phase change core, i.e. the motor vehicle fuel pump cover, from a production mold.

Alternatively, a further production method is also provided, in which firstly the cover housing is formed, with a hollow space for accommodating the phase change core being formed in the cover housing. In a further step, the phase change core, in a preferably liquid state or preferably in a solid state, is introduced into the hollow space or into the recess of the cover housing.

In a preferred embodiment of the production method, firstly the phase change core is introduced into a cover housing mold. The phase change core is preferably held in position in the cover housing mold by way of one or more retaining pins or retaining arms. The remaining hollow space (space between cover housing mold and phase change core) in the cover housing mold is then preferably filled with a cover housing material. The motor vehicle fuel pump cover is formed by this filling of the cover housing mold and thus the complete or partial encasing of the phase change core.

Other objects, advantages and novel features of the present invention will become apparent from the following detailed description of one or more preferred embodiments when considered in conjunction with the accompanying drawing.

BRIEF DESCRIPTION OF THE DRAWING

FIG. 1 is a sectional illustration of a motor vehicle fuel pump having a mounted motor vehicle fuel pump cover.

DETAILED DESCRIPTION OF THE DRAWING

The motor vehicle fuel pump 1 is partially surrounded by a motor vehicle fuel pump cover 2. The motor vehicle fuel pump cover 2 has a phase change core 3, which is accommodated in a cover housing 4 and is partially surrounded by the latter. In this case, the phase change core 3 contacts the fuel guide region 5 of the motor vehicle fuel pump 1 directly with that region which is not surrounded by the cover housing.

The motor vehicle fuel pump cover 2 forms a fluid-tight latching connection with the motor vehicle fuel pump 1, in the regions 6 and 7 in the sectional illustration, so that even if the phase change core 3 has changed into its liquid state, it cannot escape from the hollow space in which it is accommodated.

In the present case, the cover housing 4 consists of a closed-pore polyurethane foam, such that the phase change core 3, if it has absorbed thermal energy from the fuel and has changed into its liquid state, cannot escape from the hollow space in which it is accommodated. Furthermore, a motor vehicle fuel pump cover 2 of this type has sufficient flexibility for mounting on the motor vehicle fuel pump 1.

The motor vehicle fuel pump 1 has pump connections 8, by means of which fuel is taken in and released. The cover housing 4 has a recess 9, which is closed by way of a sealing plug 10. The recess 9 is provided so that, during the production of the motor vehicle fuel pump cover 2, a retaining arm (not shown) holds the phase change core 3 in the production mold (not shown) at a predefined position, such that the phase change core 3 can be surrounded with the cover housing 4.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A motor vehicle fuel pump cover for covering a fuel guide region of a motor vehicle fuel pump, comprising:

a cover housing; and a phase change core accommodated in the cover housing, wherein the phase change core is positioned, relative to the fuel guide region, at such a distance therefrom so as to change its phase state by taking up thermal energy directly from the fuel guide region, and the phase change core is configured to change its phase at a temperature of more than 60° C.

2. The motor vehicle fuel pump cover as claimed in claim 1, wherein the cover housing surrounds the phase change core partially or completely.

3. The motor vehicle fuel pump cover as claimed in claim 2, wherein the cover housing is made of a closed-pore foam.

4. The motor vehicle fuel pump cover as claimed in claim 1, wherein the phase change core comprises wax or paraffin.

5. A motor vehicle fuel pump, comprising:

a motor vehicle fuel pump cover as claimed in claim 1; and a fuel guide region of the motor vehicle fuel pump having an outer surface, wherein in an intended mounted state, the cover housing has an inner surface facing toward the motor vehicle fuel pump, and the outer surface and the inner surface delimit a hollow space, wherein the phase change core is arranged in the hollow space.

6. The motor vehicle fuel pump as claimed in claim 5, wherein the cover housing is connected in a form-fitting manner to the motor vehicle fuel pump.

7. A method for producing a motor vehicle fuel pump cover, the method comprising the steps of:

providing a phase change core, wherein the phase change core is positioned, relative to a fuel guide region, at such a distance therefrom so as to change its phase state by taking up thermal energy directly from the fuel guide region, and further wherein the phase core changes phase at a temperature greater than 60° C.;

partially or completely encasing the phase change core with a cover housing; and shaping the motor vehicle fuel pump cover.

8. The method for producing a motor vehicle fuel pump cover as claimed in claim 7, wherein the phase change core is introduced into a cover housing mold, and a remaining hollow space in said cover housing mold is filled with a cover housing material, such that the motor vehicle pump cover is formed.

9. The motor vehicle fuel pump cover as claimed in claim 1, wherein the phase change core contacts a surface of the fuel pump directly in an area where a fuel is pumped.

10. The method as claimed in claim 7, wherein the phase change core contacts a surface of the fuel pump directly in an area where a fuel is pumped.

* * * * *